US008201891B2

(12) United States Patent
Damian

(10) Patent No.: US 8,201,891 B2
(45) Date of Patent: Jun. 19, 2012

(54) LEG REST AND EXERCISING DEVICE

(76) Inventor: Flamey Damian, Malibu, CA (US)

( * ) Notice: Subject to any disclaimer, the term of this patent is extended or adjusted under 35 U.S.C. 154(b) by 129 days.

(21) Appl. No.: 12/410,279

(22) Filed: Mar. 24, 2009

(65) Prior Publication Data

US 2010/0244535 A1 Sep. 30, 2010

(51) Int. Cl.
*A47C 16/00* (2006.01)

(52) U.S. Cl. ..... 297/423.39; 297/423.41

(58) Field of Classification Search ..... 297/423.36, 297/423.41, 423.42, 423.43, 423.44, 228.13; 5/624, 648, 649, 651
See application file for complete search history.

(56) References Cited

U.S. PATENT DOCUMENTS 110,240 A * 12/1870 James ..... 297/423.39
120,176 A * 10/1871 Withall ..... 297/423.39
621,098 A * 3/1899 Kelly ..... 248/371
2,856,986 A * 10/1958 O'Leary ..... 297/423.43
2,881,823 A * 4/1959 Abraham ..... 297/423.42
3,051,527 A * 8/1962 McKenna ..... 297/423.45
3,104,446 A * 9/1963 Throop, Jr. ..... 27/21.1
3,482,566 A * 12/1969 Watkins ..... 128/882
4,067,614 A * 1/1978 Confer et al. ..... 297/423.39
4,826,151 A * 5/1989 Nuredin ..... 482/68
5,020,197 A * 6/1991 Bull ..... 27/21.1
5,149,003 A * 9/1992 Tharp ..... 242/596.3
6,045,192 A * 4/2000 Faulise ..... 297/423.39
6,124,009 A * 9/2000 Havens ..... 428/57
6,564,407 B1 * 5/2003 Luu et al. ..... 5/654
6,810,544 B1 * 11/2004 Smith ..... 5/648

* cited by examiner

*Primary Examiner* — Sarah B McPartlin

(57) ABSTRACT

A leg rest and exercise apparatus constructed of an elongated planar member having concave depressions in one end thereof for receiving the legs of a user. The opposite end of the planar member has an irregular surface, preferably a plurality of protrusions, for engaging a support surface to prevent the apparatus from sliding during use.

3 Claims, 2 Drawing Sheets

LEG REST AND EXERCISING DEVICE

BACKGROUND OF THE INVENTION

Field of the Invention

The present invention relates to exercise devices and more particularly to a leg rest and exercise device that can be used by a person in a sitting or reclining position.

The lower extremities of the human, that is, that portion located approximately between the waste line and feet receives little, if any, movement when a person is seated. When such occurs muscles are not in motion and the blood supplied to the muscles tends to decrease or become stale. In response the muscles can stiffen, atrophy and the like. As a result, blood clots and other abnormalities can occur.

This becomes even more acute if a patient is recovering from leg or hip surgery. The accumulation of excess fluid known as edema can occur as a result of a higher osmotic pressure in the tissue surrounding the veins and in the veins themselves. The excess fluid causes additional swelling which is uncomfortable to the patient and may lead to other undesirable conditions such for example as venous stasis. This in turn may further lead to venous thrombosis and the venous thrombosis may result in vein occlusion and possible pulmonary emboli or clots to the lung which are potentially fatal. In addition, the lack of circulation also tends to retard convalescence of the operative portion of the leg or hip.

It is therefore highly desirable to promote and facilitate venous outflow from the lower extremities. This may be accomplished by physical exercise and elevation of the lower extremity. Exercising the lower muscles while seated or reclined causes blood flow through the lower extremity to increase and the effects of remaining in a seated or reclined position for extended periods of time to ameliorate. Accordingly, there exists a need for an exercise device which can be used for leg exercises while the user is in a seated or reclining position to increase blood flow to the lower extremities. Many prior art more complicated exercising and leg support devices exist. These devices are for the most part constructed of numerous components which are brought together by the user and which may be used by the user to either rest the legs or to exercise the legs while in a seated or reclining position. Such devices are expensive, cumbersome to use and also require a substantial amount of storage space when not in use. Therefore, the need exists for a simple device which can be easily stored when not in use and which is simple to utilize and can be used by the user when seated or in a reclining position to both rest the legs and to exercise the legs.

It is a common practice of chiropractics and medical institutions to use weights with pulleys and cords connected to the lower part of the body or legs in order to achieve a pain relief on the hip or lower back, by a pulling or tugging action. A more sophisticated method to relieve pain used by chiropractors is the usage of a motorized table like device whereupon the patient lies on his or her back and the motorized device with its alternate pulling of the lower extremities relieves the pain. Such requires a visit to the chiropractor's office or a hospital to receive the desired treatment.

SUMMARY OF THE INVENTION

The present invention provides a leg rest and exercising or tug device which includes an elongated planar member having first and second ends. The first end of the member defines a pair of concave or recessed portions which receive the lower portion of the leg of the user. The concave portions are padded to provide additional comfort to the user. The second end of the planar member has an irregular surface which contacts a support surface upon which the device rests while being used. The irregular surface prevents the device from slipping while it is being used.

DETAILED DESCRIPTION

The present invention is directed to a very simple leg support and exercise device which can be utilized by an individual who merely wishes to rest his/her legs or alternatively to exercise his/her legs when seated or reclining or to apply a pulling force to the legs to reduce back or hip discomfort. The device of the present invention consists of a single elongated planar member which can be placed by the user upon a support surface such as a floor and then while seated or reclining the user can place his/her legs upon the top end of the device within a pair of concave recesses designed to receive the legs of the user at approximately the ankle area thereof. The user may then manipulate his/or legs by bending the knees and drawing the apparatus toward the user and then extending the legs to straighten the knees thereby moving the apparatus away from the user. This movement of the apparatus to and from the user provides a physical exercise for the lower extremity of the user's body thus increasing the blood flow through the lower extremities thereby mitigating edema formation.

Sitting in one's favorite chair with the upper part of the heels resting over the outer edge of the rubber padded recesses one can experience a variable pulling of the legs as direct result of the planar member angle held in relation to the floor and to the legs weight. When using the devices in an absolute vertical or 90 degree to the floor, no pulling of the legs is exerted. However, if the top of the device is titled away from the user or its end resting on a support surface is brought closer to the user, therefore reducing the angle degree of the outer face position to the floor to less than 90 degrees, the pulling force on the legs increases. The device tilted at a 70 to 60 degree angle to the support surface offers a preferred tug or pull of the legs. In essence, one can also control the amount of pulling force that is personally preferred by extending or retraction of the legs. Such movement results in exercise. The device can be used to rest, exercise or tug the legs by a simple desirable and satisfying application. Leg muscle relaxation by tugging can be achieved in a sitting position while for lower back and hip pain relief the use of a recliner chair is suggested.

Figure 1:
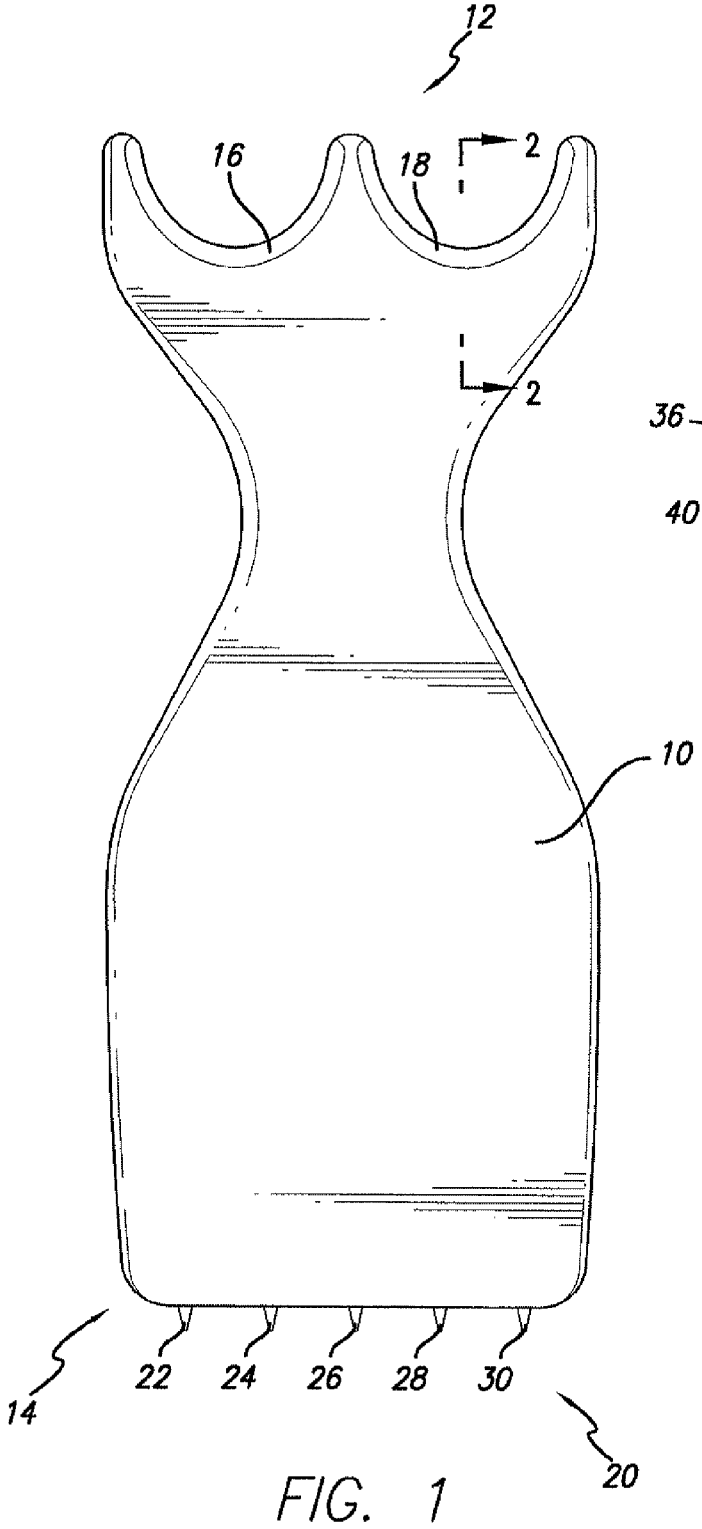
FIG. 1 is an elevational view of the leg rest and exercising device of the present invention.
Figure 4:
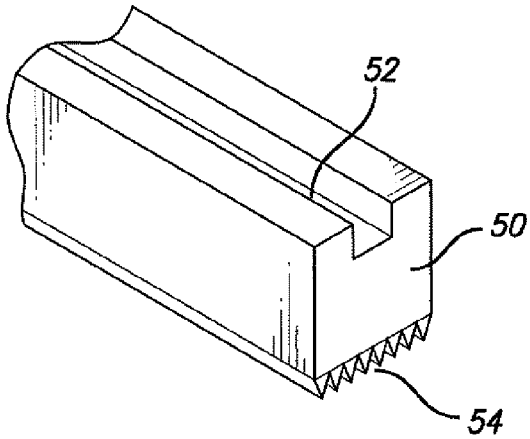
FIG. 4 illustrates an alternative view of the end of the device for engaging a support surface.

As is seen in FIG. 1, the exercise device of the present invention includes an elongated planar member 10 which has a first end 12 and a second end 14. The first end 12 defines a pair of concave depressions 16 and 18 which are adapted to receive the legs of the user when the user is in a seated or reclining position. The second end 14 of the planar member 10 includes an irregular surface 20 which may include a plurality of outwardly extending protrusions 22, 24, 26, 28 and 30. In one specific embodiment of the present invention these protrusions 22, 24, 26, 28 and 30 may be metal prongs which extend from the second end 14. Alternatively, the irregular surface 20 may be defined by ribs or extensions from the material from which the planar member 10 is manufactured. In some circumstances, particularly when the support surface is hard and dry the irregular surface 20 may be modified to have a surface which will not slip on the hard dry supporting surface. One embodiment to provide such is illustrated in FIG. 4 and includes a rubber strip 50 which defines a slot or depression 52 on the upper surface which receives the irregular surface 20 and holds the strip in place. The lower part 54 of the strip is formed to have a plurality of griping members such as ribs or points which engage the hard dry support surface in a non-slipping manner. The planar elongated member 10 may be constructed of any material desired, for example wood or molded plastic or if the device is to be used under hospital conditions it may be constructed of stainless steel which can then be subjected to appropriate sterilization processes. If the planar member is constructed of plastic, it may be a solid member of a thermo-setting plastic or an injection molded plastic or a rotationally molded hollow member filled with polyurethane foam.

Figure 2:
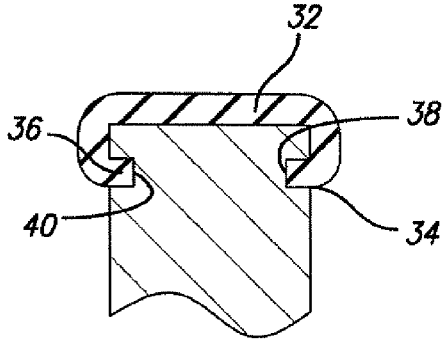
FIG. 2 is a cross sectional view taken about the lines 2-2 of FIG. 1 an illustrates the manner in which the padding is retained on the concave surfaces.

Referring more specifically to FIG. 2, it will be noted that the concave depressions 16 and 18 have a pad 32 positioned thereon to provide more comfort to the user. The pad 32 is preferably constructed of an elastomeric material which is elastically deformable. The pad includes a pair of downwardly and inwardly extending arms 34 and 36 terminating in an inwardly directed flange which is received within a groove 38 and 40 respectively which is defined adjacent, but below the edge of the concave depressions in the first end 12 of the planar member 10. By such construction the pad 32 may be snapped into place or alternatively may be removed for replacement or cleaning as the situation may require.

Figure 3:
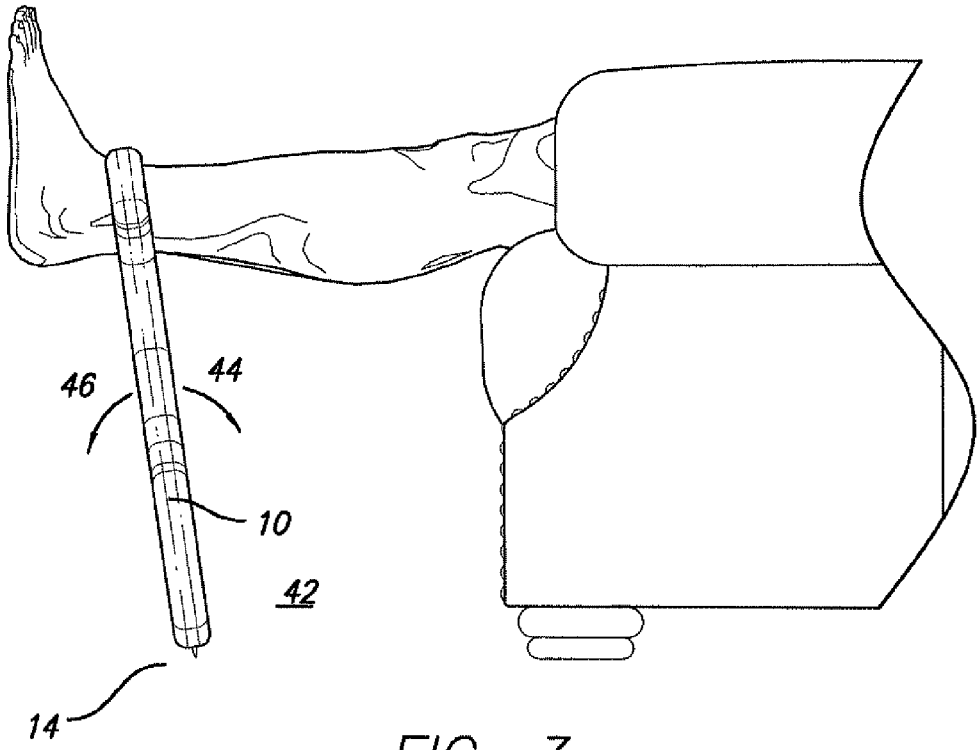
FIG. 3 is a side view showing the device of the present invention in use by the user while in a seated or reclining position.

By reference now more particularly to FIG. 3, there is shown the legs of a user who is seated with the planar member 10 resting upon a support surface 42. The second end 14 of the member 10 rests upon the supporting surface 42 and the irregular surface 20 of the second end 14 engages the support surface 42 and through appropriate friction maintains the second end 14 in firm contact with the support surface 42. Such allows the user to manipulate the planar member 10 by moving it toward the user as shown at 44 or away from the user as shown at 46. This is accomplished by bending the knees of the user and manipulating the planar member 10 as illustrated in FIG. 3. Such activity provides the exercise above referred to and accomplishes the increased blood flow that is above-described. Obviously, the user may use the exercise and leg rest device of the present invention while seated as shown or reclining, if such is desired.

To relieve lower back and hip discomfort the irregular surface 20 may be positioned closer to the user so that it resides at an angle of approximately 60-70 degrees with respect to the support surface. This positioning applies a pull or tug to the legs of the user thereby mitigating discomfort to the lower back or hip. The user may then manipulate the member 10 as shown by the arrows 44-46 to further enhance the tugging or pulling force on the legs as desired.

There has thus been described a leg rest and exercise device which is quite simple in construction, may be easily stored in a minimal space and can be used without any type of assembly simply by placing the same on a support surface and positioning the legs upon the device and then manipulating the device with the legs to accomplish the exercise.

What is claimed is:

1. A combination leg rest and exercise apparatus for use by a user when in a seated or reclining position to apply a pulling force to the legs to reduce back or hip discomfort comprising:

a. A single elongated planar member having first and second ends;

b. said first end having first and second spaced apart concave depressions for receiving the lower extremity of a user's legs when the user is in a seated or reclining position;

c. a separate pad formed of an elastically deformable material secured to each of said first and second spaced apart concave depressions;

d. said second end arranged to rest upon a support surface and to allow the user to manipulate the single elongated member toward and away from the user for exercise purposes or to apply a pulling force to the legs;

e. said second end having an irregular surface formed from rubber material for engaging said support surface to prevent slippage of said second end of said planar member during manipulation thereof by a user toward and away from the user; and f. said elongated planar member having a length sufficient to elevate the lower extremity of the legs of a user while the user is seated and to allow the user to retract and extend the legs.

2. A combination leg rest and exercise apparatus as defined in claim 1 where said first end of said planar member defines a groove adjacent and below each of said concave depressions and said pad includes first and second pads each defining a downwardly and inwardly directed arm terminating in a flange which is received within one of said grooves to hold each first and second said pad in place.

3. A combination leg rest and exercise apparatus as defined in claim 1 wherein said irregular surface formed from rubber material is a rubber strip having first and second surfaces, said first surface of said rubber strip defining a slot for receiving said second end of said elongated member and said second surface of said rubber strip having a plurality of gripping members for engaging said support surface.

* * * * *